US006505361B1

(12) United States Patent
Ogawa

(10) Patent No.: US 6,505,361 B1
(45) Date of Patent: Jan. 14, 2003

(54) VIBRATION GENERATOR

(75) Inventor: Takayuki Ogawa, Gifu (JP)

(73) Assignee: Ken Hayashibara, Okayama (JP)

( * ) Notice: Subject to any disclaimer, the term of this patent is extended or adjusted under 35 U.S.C. 154(b) by 0 days.

(21) Appl. No.: 09/720,544

(22) PCT Filed: Apr. 27, 1999

(86) PCT No.: PCT/JP99/02256

§ 371 (c)(1),
(2), (4) Date: Dec. 27, 2000

(87) PCT Pub. No.: WO00/64598

PCT Pub. Date: Nov. 2, 2000

(51) Int. Cl.[7] ..... A61H 1/00
(52) U.S. Cl. ..... 5/109; 5/915; 1/49; 1/60
(58) Field of Search ..... 5/108, 109, 915; 601/49, 50, 57, 58, 60

(56) References Cited

U.S. PATENT DOCUMENTS 2,902,993 A * 9/1959 Wagner ..... 5/633
3,092,099 A * 6/1963 Berard ..... 601/58
3,311,935 A * 4/1967 Petty ..... 5/109
3,678,923 A * 7/1972 Oetinger ..... 601/48
3,811,430 A * 5/1974 Kawakami ..... 601/57
6,056,357 A * 5/2000 Fukuoka ..... 297/217.3

* cited by examiner

*Primary Examiner*—Michael F. Trettel
(74) *Attorney, Agent, or Firm*—Browdy and Neimark, P.L.L.C.

(57) ABSTRACT

Disclosed are a vibration generator which comprises a rotary drive means having a drive shaft, at least a pair of rotors which is installed on the drive shaft and is rotative in association with the drive shaft, and unbalanced weights which are respectively installed in the rotors; and an apparatus for controlling the function of living bodies, which comprises the vibration generator as a vibration generating source.

8 Claims, 4 Drawing Sheets

VIBRATION GENERATOR

The present application is the national stage under 35 U.S.C. 371 of PCT/JP99/02256, filed Apr. 27, 1999.

TECHNICAL FIELD

The present invention relates to a vibration generator, and more particularly, to an apparatus for generating mechanical vibration by combining a rotary drive means having a drive shaft and rotors having unbalanced weights.

BACKGROUND ART

In a bustling and complicated modern society, our mental and spiritual stresses, which are induced by anxiety, dissatisfaction, anger, and irritation, are increasing. Accumulation of these stresses may result in symptoms of insomnia including difficulty of sleeping, night awakening, morning awakening, defectiveness of sound sleep feeling, and shortening of sleep. Chronic insomnia may successively cause easy fatigue, malaise, and palpitation, and this results in lowering of mentation and spoiling of concentration of thinking on matters and events, and in some cases even may result in dystrophy and destroy the living of normal social life. The number of insomnia patients is now estimated to be more than several millions mostly in advanced nations.

General method for overcoming insomnia is to take narcotics while receiving professional counseling. Since the actual use of benzoazepine and thienodiazepine hypnotics has been realized, narcotics can be continuously administered to patients for a relatively-long period of time with less fear of considering drug safeness, drug dependency, and drug tolerance. However, narcotics for overcoming insomnia generally require doctor's prescriptions and could not be used freely at home in general. In view of these difficulties in narcotics, there have been proposed a variety of vibration generators for inducing sleep by vibrating the body. Among these, as disclosed in Japanese Patent Kokai No. 251,278/90, a vibration generator, which comprises a pair of rotors having unbalanced weights provided counteractively each other, a pair of rotary drive means having drive shafts installed in respective rotors, and a phase difference controlling means for electrically regulating the rotary drive means to allow the pair of rotors to rotate at a prescribed phase difference, is known as an apparatus for generating mechanical vibration by combining rotary drive means having drive shafts and rotors having unbalanced weights.

Such a vibration generator, however, has the demerits that it inevitably requires a pair of rotary drive means, and they should be continuously controlled by a phase difference controlling means when operated. In principal, the vibration generator has the difficulty of altering only its amplitude while keeping the vibration frequency at a prescribed level.

OBJECT OF THE INVENTION

The present invention was made to overcome the drawbacks of conventional apparatuses which generate mechanical vibration by combining a rotary drive means having a drive shaft and rotors having unbalanced weights, and aims to provide a vibration generator which requires no phase difference controlling means that electrically controls the rotational phase difference between the rotors.

In addition, the present invention aims to provide a vibration generator which can easily alter only the amplitude while keeping the vibration frequency at a prescribed level.

The present vibration generator, which fulfills the above objects, relates to a vibration generator which comprises a rotary drive means having a drive shaft, a plurality of rotors which are provided on the drive shaft and capable of rotating in association with the drive shaft, and unbalanced weights which are installed in the respective rotors; and more particularly to a vibration generator in which one of the rotors is provided in such a manner that it can rotate against or along the drive shaft.

The present invention also relates to an apparatus for controlling the function of living bodies, which uses the above vibration generator as a vibration source.

BRIEF EXPLANATION OF THE ACCOMPANYING DRAWINGS

Throughout FIGS. 1 to 4 and 6, the numeral 1 is a rotary drive means; 2, an elastic material; 3, a platform; 4, a drive shaft; 5, a bearing; 6, 7, 16, 17 and 18, rotors; 8 and 9, unbalanced weights; 10, a male spiral; 11, a transporting mechanism; 12, a holding table; 13, a transporting spiral; 14, a transporting handle; 15, a case; 19, a vibration generator; and 20, a mat.

BEST MODE OF THE INVENTION

Figure 1:
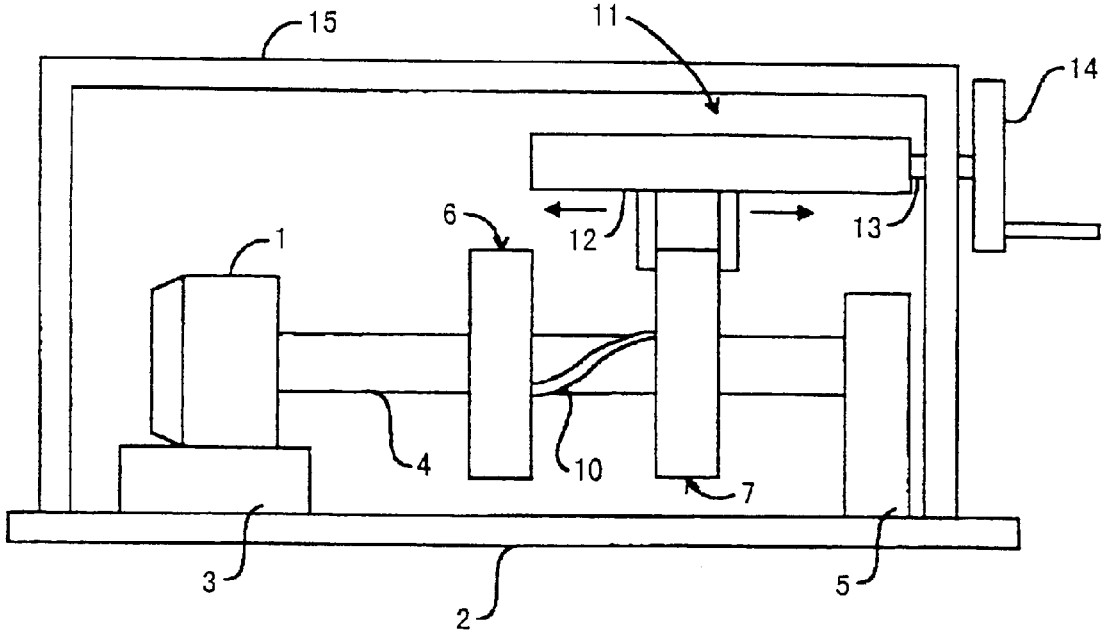
FIG. 1 is a figure for explaining an example of the present invention.
Figure 2:
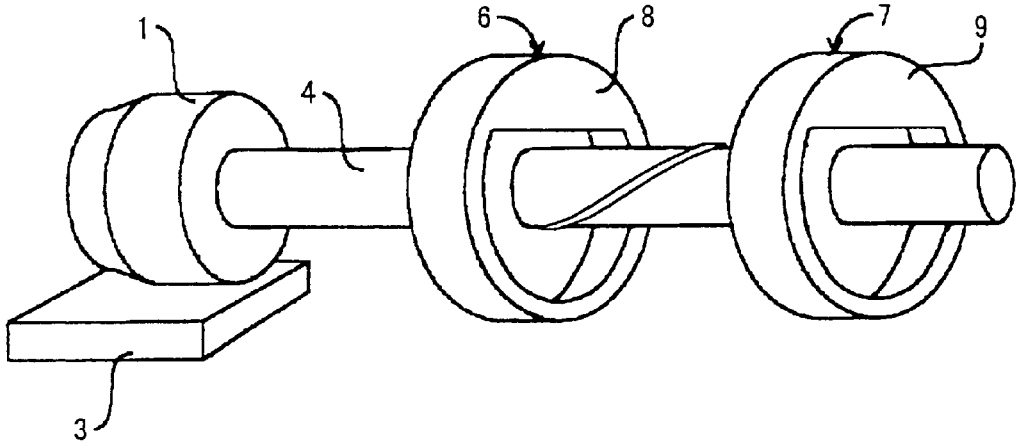
FIG. 2 is a figure for explaining rotors and unbalanced weights used in the example as shown in FIG. 1.
Figure 3:
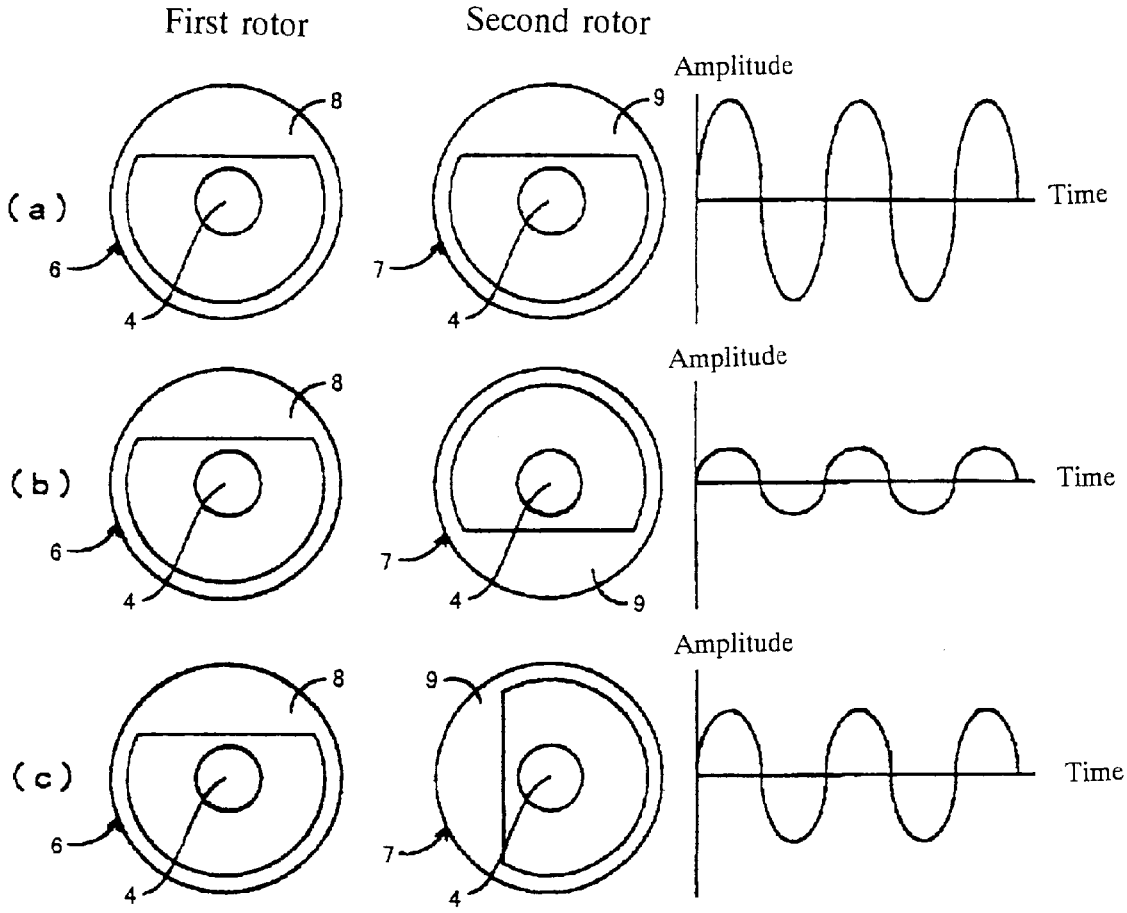
FIG. 3 is a figure for explaining the amplitude change of vibration observed when the relative position of the unbalanced weights in a pair of rotors is changed; wherein FIG. 3(*a*) is in a condition for a large amplitude, FIG. 3(*b*) is for a small amplitude, and FIG. 3(*c*) is for a medium amplitude.

The present invention is explained with reference to the example as shown in the following figures: In FIGS. 1 to 3, the numeral 1 is a rotary drive means, an electric motor. The numeral 2 is an elastic material made of an elastic metal plate for eliciting a generated vibration, and a rotary drive means 1 is provided on either side of the elastic metal plate via a platform 3. The rotary drive means 1 is provided with an elongated drive shaft 4, the end of which is rotatively holed by a bearing 5. In this example, although the bearing 5 prepared previously is installed in the elastic material 2, the bearing 5 can be omitted, for example, when either end of the elastic material 2 is folded and a hole is made in an appropriate position of the elastic material 2 so as to rotatively hold the drive shaft 4.

The numerals 6 and 7 are rotors which are generally formed circularly by using metals such as iron, copper, lead or brass, or alloys. The numerals 8 and 9 are unbalanced weights which are usually made of similar materials as used in the rotors 6 and 7 and are, as found in FIG. 2, integrated on both sides of the rotors 6 and 7 or installed in the both sides of the rotors 6 and 7 after prepared separately. Both of the rotors 6 and 7 are installed in the drive shaft 4 through a perforated hole, which is not shown in any figure, so as to rotate in association with the drive shaft 4. In this example, among the rotors 6 and 7, only the first rotor 6, positioning nearness to the rotary drive means 1, is fixed to the drive shaft 4; and the second rotor 7, positioning nearness to the bearing 5, is provided along the drive shaft 4 to move rotatively to the axial direction of the drive shaft 4 by means of the following transporting means.

As found in FIG. 1, the transporting means in this example comprises a male spiral 10 carved spirally on the drive shaft 4; a female spiral, which is not shown in any figure, curved on the surface of the inner wall of a hole perforated through the drive shaft 4 in the rotor 7 so as to spirally couple with the male spiral 10; and a transporting mechanism 11 which holds and transports the rotor 7 in a spiral and rotatory manner along the drive shaft 4. In this case, the female spiral can be curved on the surface of the drive shaft 4 and the male spiral can be curved on the surface of the inner wall of the hole perforated through the rotor 7.

The transporting mechanism 11 comprises a holding table 12 which holds the rotor 7 to allow it to rotate, a transporting spiral 13 coupled spirally with a spiral hole perforated through the holding table 12, and a transporting handle 14 which rotatively moves the transporting spiral 13. The holding table 12 is installed in the later described case 15 by a fixing means, which is not shown in any figure, in such a manner that it can move to the elongated longitudinal direction of the holding table 12 but can not rotate in itself, whereby when the transporting handle 14 is handled to rotate the transporting spiral 13, the holding table 12 is forced to move to its elongated longitudinal direction without rotating in itself. The male spiral 10 is arranged to have a relatively-large pitch to quickly and rotatively move the rotor 7 along the drive shaft 4 when the transporting mechanism 11 is actuated. The male spiral 10 curved on the drive shaft 4 is usually arranged to have a length sufficient to change the phase difference 180° between the unbalanced weights 8 and 9 by handling the transportation handle 14. As found in FIG. 1, since a part of the holding table 12 contacts with the periphery of the rotor 7, it may be worn away as the rotor 7 rotates. Accordingly, it can be preferably provided a means such as a ball bearing or the like which smooths the rotation of the rotor 7 and lowers the abrasion of the part of the holding table 12 which contacts with the rotor 7.

The numeral 15 is a case, and as shown in FIG. 1 it encloses the major part of the vibration generator while allowing only the transporting handle 14 to expose outside the case 15. In this example, although the transportation mechanism 11 is constructed so as to actuate the holding table 12 by manually handling the transportation handle 14, the transportation means usable in the present invention should not be restricted only to such a mechanism but can be constructed in such a manner that the major parts of the handing table 12, the transporting spiral 13, and the transportation handle 14 can be constructed by a linear motor and a control circuit for electrically controlling the linear movement of the motor.

In this example, although there employed is a method for rotatively moving the rotor 7 along the drive shaft 4 to alter the phase between the unbalanced weights 8 and 9 in the rotors 6 and 7, the method for altering the phase between the rotors should not be restricted only to the above method, and any other methods can be employed in the present invention as long as they can alter the phase between the unbalanced weights provided in the rotors. As another method, for example, it can be exemplified a method which comprises providing a ratchet mechanism for latching together the perforated hole in the rotor 7 and an appropriate position of the drive shaft 4, allowing the rotor 7 to rotate manually or semiautomatically in a relative manner with respect to the shaft drive 4 to alter the phase of the unbalanced weight 9, provided in the rotor 7, to the unbalanced weight 8. In this case, for example, when the rotation angle of the unbalanced weight 9 and a desired amplitude of vibration level are previously indicated on the periphery of the rotor 7 with letters, numerals, colors, and other symbols, and then the indication part is allowed to expose outside the case 15, the phase position of the rotor 7 to the rotor 6 can be appropriately and easily changed from outside the case 15 by handling the indication part externally, manually or semi-automatically.

Explaining now the operation mechanism of the vibration generator of the example, due to the unbalanced weights 8 and 9, the rotors 6 and 7 are in an eccentric condition in mass against the rotational center of the rotor 4, and this generates vibration around the drive shaft 4 when an electric motor, i.e., the rotary drive means 1, is actuated to rotate the rotors 6 and 7 in association with the drive shaft 4. The vibration generated around the drive shaft 4 is transmitted to the elastic material 2 via the rotary drive means 1, the platform 3, and the bearing 5, resulting in imparting a vibration at a relatively-low frequency, and preferably a frequency of 60 to 110 Hz to the body locally or systematically when the body of living bodies is allowed to contact with the elastic material 2 directly or indirectly. The frequency of the generated vibration can be altered by increasing or decreasing the rotational frequency of the rotary drive means 1.

Unlike conventional similar types of vibration generators, the vibration generator of this example, which uses a rotary drive means having a drive shaft and a plurality of rotors having unbalanced weights though, can be constructed with only one rotary drive means with no need of a phase difference controlling circuit for electrically controlling the rotary drive means.

The vibration generator of this example has another feature that it can continuously alter the vibration amplitude or strength to a desired level by only handling the transportation handle 14 while keeping the generating frequency at a prescribed level.

In the mechanism of this example, the rotation of the transportation handle 14 allows the rotor 7 to rotate along the drive shaft 4, and this alters the phase position of the unbalanced weight 9 and changes the phase difference between the eccentric masses of the rotors 6 and 7 to alter the generated vibration amplitude. For example, as found in FIG. 3(*a*), when the unbalanced weights 8 and 9 are positioned at the same phase position from the rotational center of the drive shaft 4, the total vector of centrifugal force actuated on the rotors 6 and 7 becomes large, and this makes the amplitude of generating vibration large. Inversely, as found in FIG. 3(*b*), when the second rotor 7 is rotationally moved by the transportation mechanism 11 in order to move the unbalanced weight 9 to the position at an angle of 180 from the position of FIG. 3(*a*), the total vector of centrifugal force actuated on the rotors 6 and 7 becomes small, and the amplitude of generating vibration becomes small. As found in FIG. 3(*c*), when a medium level of amplitude is required, the transportation mechanism 11 is forced to rotationally move the second rotor 7 to place the unbalanced weights 8 and 9 at different positions with an angle of 90° each other.

Figure 4:
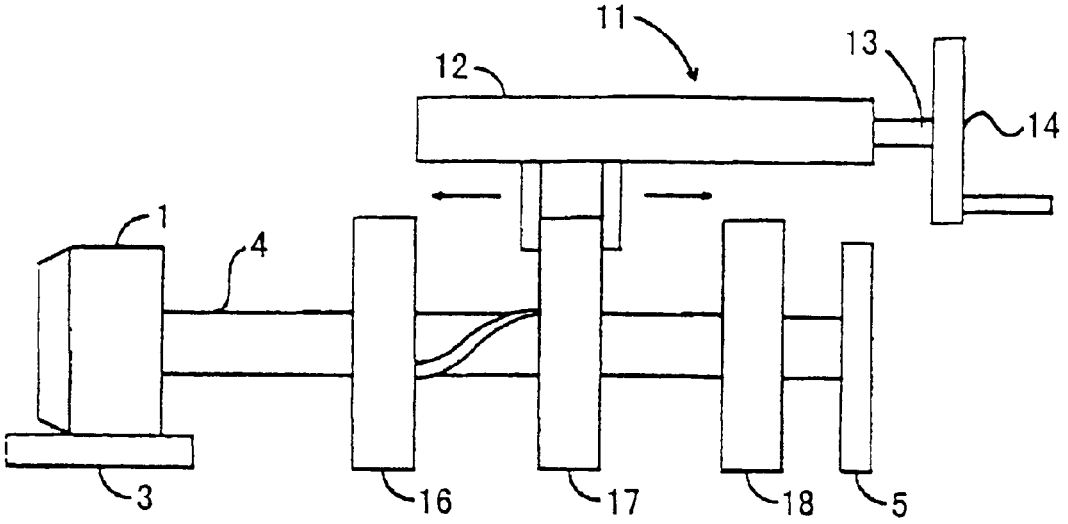
FIG. 4 is a figure for explaining another example of the present invention.

The example, as shown in FIGS. 1 to 3, is constructed with two rotors, however, the number of rotors used in the present invention should not be restricted to two rotors: Theoretically, any of two or more rotors can be used. For example, in another example as shown in FIG. 4, similar rotors 16, 17 and 18 as used in the above example can be employed, among which only the rotor 17 is installed in the drive shaft 4 to move rotationally and the resting rotors 16 and 18 are fixed to the drive shaft 4.

Figure 5:
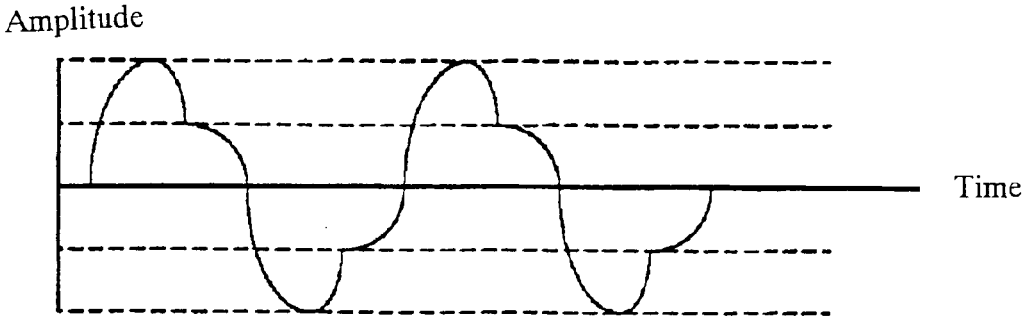
FIG. 5 is a figure for explaining the amplitude change of vibration generated by the example of FIG. 4.

In such a vibration generator, for example, when the rotors 16 and 18 are fixed to the same phase position and the rotor 17 is allowed to move rotationally along the drive shaft 4, a synthetic vibration synthesized with a plural vibration, as found in FIG. 5, is obtained. Of course, only the rotor 16 can be fixed to the drive shaft 4 and the other rotors 17 and 18 can be provided in the drive shaft 4 to move rotationally.

Explaining the use of the vibration generator of the present invention, in spite of a rather simple construction, it can generate relatively-strong vibration of a relatively-low frequency having a desired frequency and amplitude so that it can be advantageously used as a vibration generating source usable in apparatuses for imparting vibration to living bodies to control their function. Particularly, the vibration generator of the present invention, which generates vibration having a frequency of 60 to 110 Hz, i.e., a highly-sensitive frequency to the body, can be used to promote sleep of normal persons and applicable to patients suffering from insomnia induced by psychophysiologic factors, neurosis, manic-depressive psychosis, schizophrenia, and the use of drugs or alcohols; and other insomnia such as sleep apnea insomnia, alveolar hypoventilation syndrome, myoclonus insomnia during sleeping, insomnia induced by restless legs syndrome, childhood type insomnia, recurrent interruption of rapid eye movement sleep, and other insomnia induced by medical cares, intoxication, and environmental conditions; whereby the vibration generator of the present invention effectively mitigates sleep incapability, night wakefulness, morning wakefulness, deficiency of comfortable feeling of deep sleep, and the shortness of sleeping time, which are all induced by the above symptoms of insomnia; and satisfactorily inhibits abnormal dystrophy accompanied by insomnia such as sleepwalk, night terrors, bed-wetting, nightmare, epilepsies, bruxism, cephalic abnormal dystrophy during sleeping, cluster headache during sleeping, chronic sudden migraine, abnormal deglutition syndrome during sleeping, asthma during sleeping, somniloquence, and sleep drunkenness.

The vibration generator of the present invention exerts remarkable effect on insomnia induced by sleep-wake schedule disorders such as jet lag, shift-work syndrome, sleep-wake rhythm disorders accompanied by frequent work-shift, sleep-phase-delayed-type-syndrome, sleep-phase-accelerated-syndrome, non-24-hour-sleep-wake-rhythm-disorder, and irregular-sleep-wake-rhythm. When used in combination with hypnotics, the vibration generator of the present invention can lower the dose and the frequency of hypnotics, resulting in inhibition of tolerance to and dependent on hypnotics.

In addition, the apparatus for controlling the function of living bodies according to the present invention controls the biorhythm such as breathing, heat beat, blood pressure, and body heat, as well as the assimilation in metabolic system within their normal conditions; and thus it exerts strong effect on the treatment and the prevention of diseases such as circulatory-, digestive-, endocrine-, and nerve-systems, and of skin and tissue disorders including decubitus; and on the improvement and the promotion of rehabilitation and metabolism.

Respective examples of the apparatus for controlling the function of living bodies according to the present invention are bedclothes such as mats, beds, thin and hard coverlets, and pillows; chairs such as comfort chairs, chaise longues, deck chairs, bean chairs; furniture such as sofas and cushions; therapeutic tools and health appliances such as massagers, soft massagers, hair generation-accelerating apparatuses, and tooth brushes; and seats for automobiles, airplanes, boats, and ships.

Figure 6:
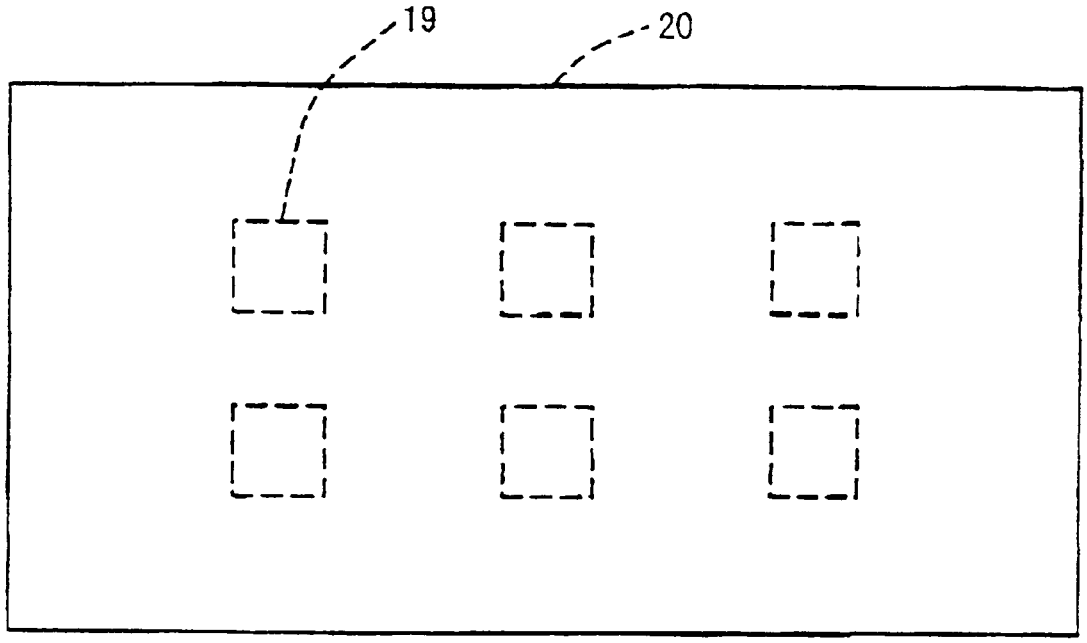
FIG. 6 is a figure for explaining an apparatus for controlling the function of living bodies by using the vibration generator of the present invention.

FIG. 6 illustrates an example for installing the present vibration generator in a bed cloth such as a mat or bed. In FIG. 6, the numeral 19 is a vibration generator; 20, a mat for bed cloth. When the vibration generator 19 is used in the mat 20 such as a bed cloth, a plural elastic material 2 in the vibration generator in FIG. 1 can be, for example, installed in the mat 20 at adequate intervals and at positions to be easily contacted with local sites of the subject when placed to face the subject.

Possibility of Industrial Applicability

As described above, in spite of a rather simple construction, the vibration generator of the present invention generates relatively-strong low-frequency vibration so that it can be extremely useful as a vibration generating source for an apparatus which imparts vibration to living bodies and controls their biological function. Particularly, the vibration generator of the present invention, which generates vibration at a frequency of 60 to 110 Hz, can be constructed into a form of bed cloth, furniture, therapeutic tool, health appliance, and seat for automobiles, airplanes, boats and ships; and advantageously used to promote sleeping, and to treat and prevent sleep deficiency, circulatory organ's deficiency, digestive organ's deficiency, and deficiency of skins and tissues including decubitus, and to improve and promote rehabilitation and metabolism.

What is claimed is:

1. A vibration generator which comprises (a) a drive shaft;

(b) means for rotationally driving said drive shaft;

(c) at least a pair of rotors on said drive shaft, at least one of said rotors can be displaced along said drive shaft in the axial direction of said drive shaft, and which is capable of rotating together with said drive shaft; and (d) unbalanced weights in said rotors.

2. The vibration generator of claim 1, wherein at least one of said rotors is capable of rotating along or against said drive shaft.

3. An apparatus for treating or preventing insomnia, which comprises, as a vibration generating source, the vibration generator of claim 2.

4. The apparatus of claim 3, which is in the form of a mat or bed.

5. The vibration generator of claim 1, which generates vibration at a frequency of 60 to 110 Hz.

6. An apparatus for treating or preventing insomnia, which comprises, as a vibration generating source, the vibration generator of claim 5.

7. The apparatus of claim 6, which is in the form of a mat or bed.

8. An apparatus for treating insomnia, which comprises, as a vibration generating source, the vibration generator of claim 1.

* * * * *

UNITED STATES PATENT AND TRADEMARK OFFICE

CERTIFICATE OF CORRECTION

PATENT NO. : 6,505,361 B1
DATED : January 7, 2003
INVENTOR(S) : Masaru Nyui et al.

It is certified that error appears in the above-identified patent and that said Letters Patent is hereby corrected as shown below:

Drawings,
Sheet 2, FIG. 2, “BEAN” should read -- BEAM --.

Column 4,
Line 54, “present” should read -- preset --.

Column 5,
Lines 49 and 62, “Wallaston” should read -- Wollaston --.

Column 6,
Line 9, “Wal-” should read -- Wol- --; and
Line 37, “Wallaston” should read -- Wollaston --.

Column 9,
Line 54, “claim 1” should read -- claim 1, --.

Column 11,
Line 18, “light” should read -- a light --.

Column 12,
Line 30, “applying,” should read -- applying --.

Signed and Sealed this

Twelfth Day of August, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,505,361 B1
DATED : January 14, 2003
INVENTOR(S) : Takayuki Ogawa

It is certified that error appears in the above-identified patent and that said Letters Patent is hereby corrected as shown below:

This certificate supersedes Certificate of Correction issued August 12, 2003, the number was erroneously mentioned and should be vacated since no Certificate of Correction was granted.

Signed and Sealed this

Thirtieth Day of March, 2004

JON W. DUDAS
*Acting Director of the United States Patent and Trademark Office*